US006837453B2

(12) United States Patent
Sturm

(10) Patent No.: US 6,837,453 B2
(45) Date of Patent: Jan. 4, 2005

(54) SHREDDER

(75) Inventor: Thomas Sturm, Zehnhausen (DE)

(73) Assignee: Vecoplan Maschinenfabrik GmbH & Co. KG, Bad Marienberg (DE)

( * ) Notice: Subject to any disclaimer, the term of this patent is extended or adjusted under 35 U.S.C. 154(b) by 208 days.

(21) Appl. No.: 10/324,506

(22) Filed: Dec. 20, 2002

(65) Prior Publication Data

US 2004/0118958 A1 Jun. 24, 2004

(51) Int. Cl.[7] ..... B02C 18/16
(52) U.S. Cl. ..... 241/243; 241/294
(58) Field of Search ..... 241/243, 294, 241/242; 144/235

(56) References Cited

U.S. PATENT DOCUMENTS 1,524,675 A * 2/1925 Smith ..... 241/240
1,944,928 A * 1/1934 Davis ..... 241/294
2,141,663 A * 12/1938 Ossing ..... 241/295
4,059,236 A * 11/1977 Brewer ..... 241/243
4,344,581 A * 8/1982 Redemann ..... 241/88.4
4,844,366 A * 7/1989 Hatanaka ..... 241/293
6,094,795 A * 8/2000 Davenport ..... 29/407.1
6,546,977 B1 * 4/2003 Monyak et al. ..... 144/235
2003/0061926 A1 4/2003 Stosky

FOREIGN PATENT DOCUMENTS

DE 39 32 345 C 2 2/1993

* cited by examiner

*Primary Examiner*—Daniel C. Crane
(74) *Attorney, Agent, or Firm*—Alston & Bird LLP

(57) ABSTRACT

A rotary shredder for shredding various materials including fibrous materials, comprising at least one rotor that carries a plurality of V-cutters axially spaced apart along the rotor to mesh with recesses between adjacent teeth of a counter knife. The rotor also carries a plurality of flat cutters. Each flat cutter has a cutting edge that is parallel to the axis of the rotor. The flat cutters are aligned in the axial direction with the teeth of the counter knife, and hence are axially positioned between axially adjacent V-cutters. The flat cutters thus are positioned to work in conjunction with the counter knife to cut material that accumulates between adjacent V-cutters.

19 Claims, 3 Drawing Sheets

SHREDDER

FIELD OF THE INVENTION

The invention relates to rotary shredders for shredding various materials, comprising a rotor and a counter knife.

BACKGROUND OF THE INVENTION

Rotary shredders are used for shredding a variety of materials such as paper, cardboard, plastic film, cloth, webbing, textile fibers of natural or synthetic material, and others. European Patent EP 419 919 B1 describes a shredder for such materials that includes a rotor having a plurality of circumferential ribs spaced apart along its length and a counter knife having teeth axially aligned with the valleys or grooves defined between the ribs of the rotor. A plurality of cutters are mounted in pockets formed in the outer surface of the rotor. Each cutter has two faces that are at a right angle to each other and form a V-shape that meshes with a correspondingly V-shaped recess between two adjacent teeth of the counter knife. Material fed into the space between the rotor and counter knife is cut into pieces by the cutters and the pieces pass through a screen that surrounds a portion of the circumference of the rotor; pieces too large to pass through the screen are carried by the rotor back to the counter knife to be cut again.

When rotary shredders such as that described in EP 419 919 are used for shredding certain "stringy" types of high tensile-strength material (such as fibers of pre-stressed polypropylene), it has been found that the material tends to wrap around the rotor and accumulate in the valleys of the rotor surface. Once the material is laying in the valleys, it cannot be cut between the rotor cutters and the counter knife. The material wrapped around the rotor increases the friction between the rotor and the counter knife as well as between the rotor and the screen, leading to high stresses on the machine, high energy consumption, and frequent overload and jamming of the machine.

SUMMARY OF THE INVENTION

The present invention addresses the problem of stringy material wrapping around the rotor, by providing a shredder in which the rotor has V-cutters axially spaced apart such that the recesses between adjacent teeth of the counter knife mesh with the V-cutters and such that each V-cutter partially overlaps in the axial direction with at least one other axially adjacent V-cutter, and a plurality of flat cutters affixed to the outer surface of the rotor. Each flat cutter has a substantially flat or straight cutting edge that is generally parallel to the axis of the rotor. The flat cutters are aligned in the axial direction with the valleys in the rotor surface, and hence are axially positioned between axially adjacent V-cutters. The flat cutters thus are positioned to work in conjunction with the counter knife to cut material that accumulates between adjacent V-cutters.

In one preferred embodiment of the invention, the teeth of the counter knife have flattened end surfaces that oppose the flat cutters. Advantageously, the teeth of the counter knife do not overlap in a radial direction with the ribs of the rotor.

To minimize the power required to rotate the rotor, it is preferred that the flat cutters be circumferentially spaced apart about the rotor such that only one flat cutter at a time meshes with the counter knife. Likewise, the V-cutters should also be spaced so that only one V-cutter at a time meshes with the counter knife.

In a preferred embodiment, the V-cutters are mounted in pockets formed in the outer surface of the rotor, and are affixed to the rotor with threaded fasteners so they can be removed and replaced when needed. Advantageously, each V-cutter is a substantially square structure having four cutting edges that form four cutting vertices, and the V-cutters are mountable to the rotor in any of four different positions each presenting a different one of the cutting vertices in position to mesh with the counter knife. Advantageously, each flat cutter is a multi-sided structure with more than one side of the structure defining a cutting edge, and the flat cutters are mountable to the rotor in any of a plurality of different positions each presenting a different one of the cutting edges in position to cooperate with the counter knife.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
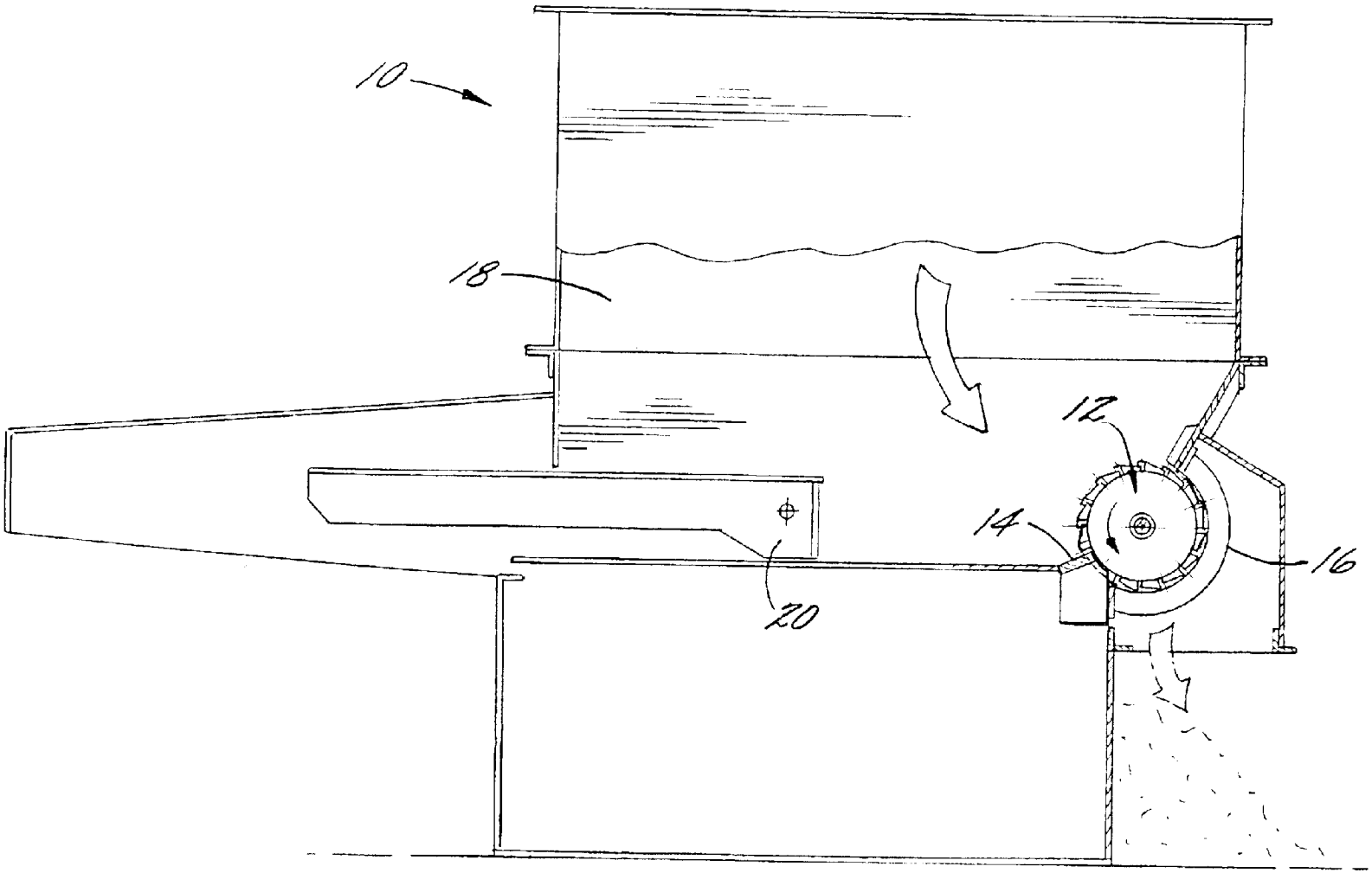
FIG. 1 depicts a shredder in accordance with one embodiment of the invention.
Figure 2:
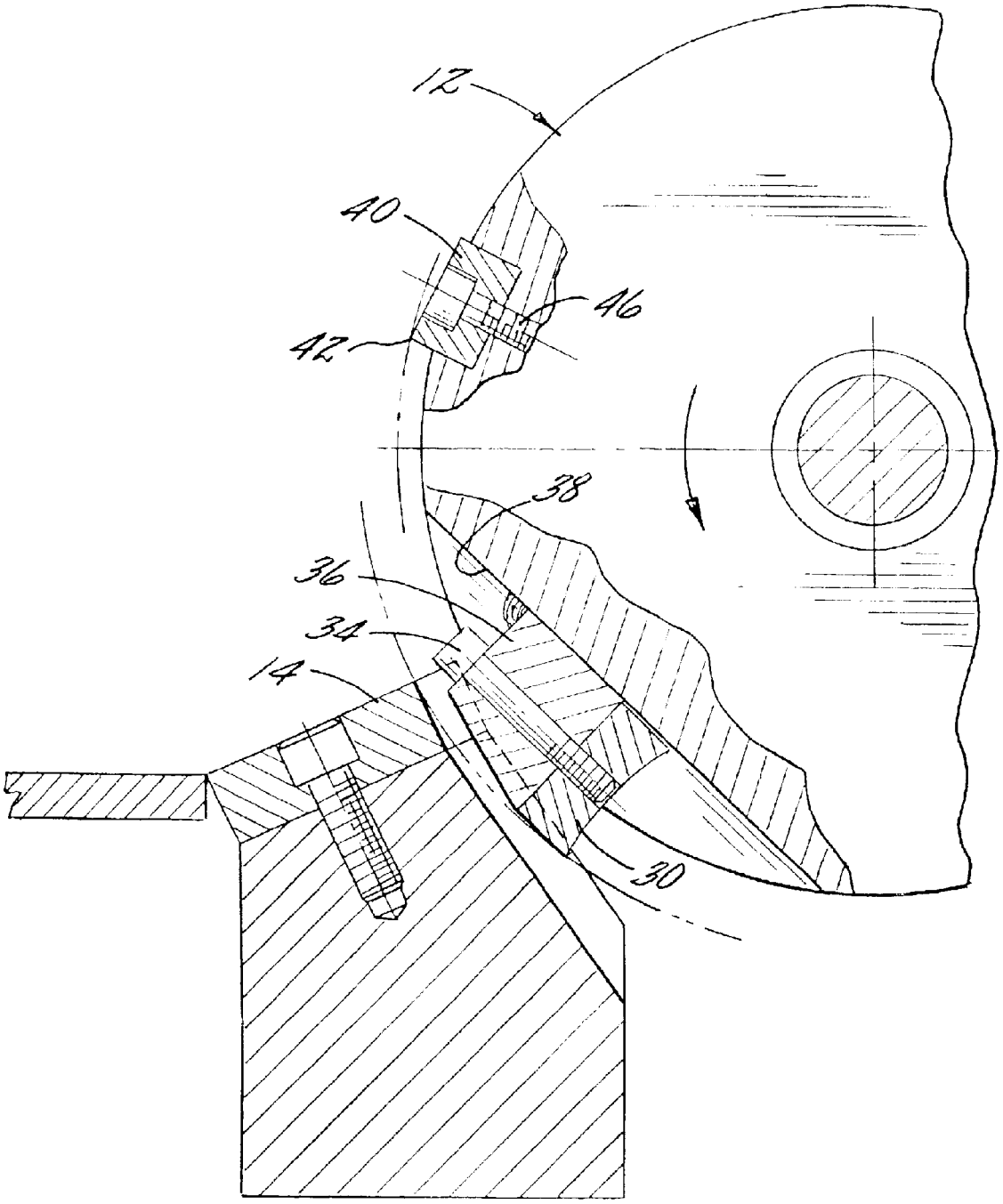
FIG. 2 is a magnified end view, partly in section, of the rotor and counter knife of the shredder of FIG. 1.

A shredder 10 in accordance with one embodiment of the invention is depicted in FIG. 1. The primary components of the shredder are a rotor 12 that carries cutters as further described below, and a counter knife 14 that works in conjunction with the rotor to grind up or shred material fed into the space where the rotor and counter knife converge. The counter knife is generally stationary, although it can be flexibly supported so that it can "give" to some extent when a very hard object (e.g., a piece of metal or a rock) is inadvertently fed into the space between the rotor and counter knife, the flexibility thereby tending to prevent damage to the machine. The ground up or shredded material exits through a screen 16 having apertures suitably sized to regulate the size of the pieces of shredded material. The shredder 10 also includes a hopper 18 for receiving material to be shredded, and a hydraulic ram 20 or the like for feeding the material into the space between the rotor and counter knife. The illustrated shredder 10 has only one rotor, but the invention is also applicable to shredders having more than one rotor. For example, two rotors can be mounted parallel and side-by-side with a space between them in which counter knives are mounted to cooperate with the rotors, each rotor also having a screen. Material to be shredded can be fed down into this space by gravity, as opposed to being fed by a hydraulic or other feed system. In other respects, a dual-rotor shredder is substantially similar to the single-rotor shredder described herein.

Figure 3:
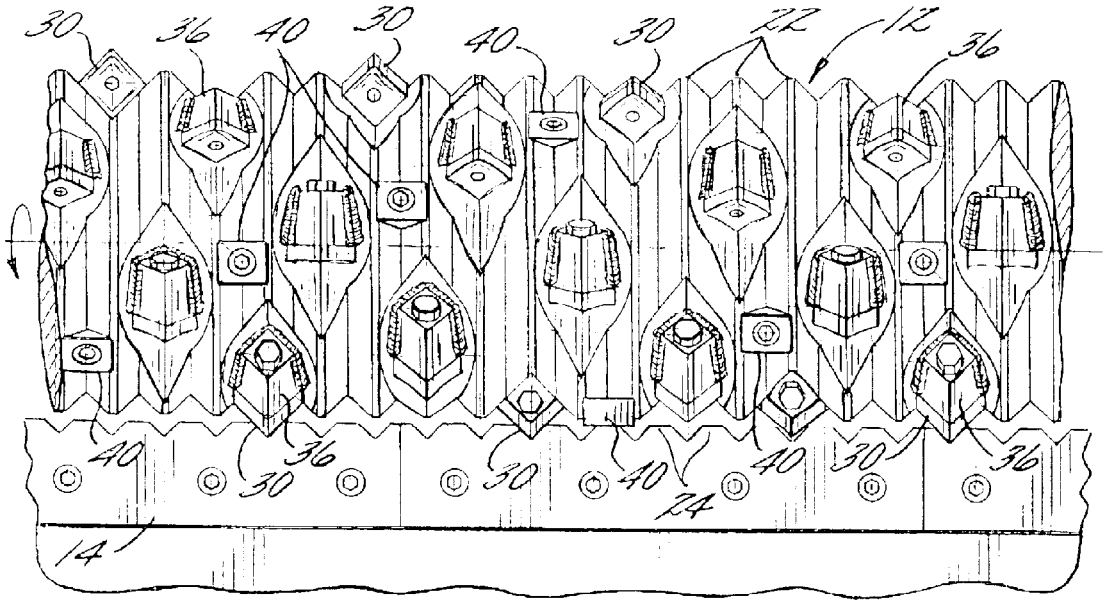
FIG. 3 is a side elevation of the rotor and counter knife of the shredder of FIG. 1.

FIG. 3 shows a portion of the length of the rotor 12 and counter knife 14 in side elevation. The rotor 12 is generally cylindrical in form, but the outer surface of the rotor defines a series of circumferential ridges or ribs 22 that project radially outwardly. In the illustrated embodiment, each rib has opposite side faces that are conical and oppositely inclined to the rotor axis, and a radially outermost surface that is parallel to the rotor axis. Thus, in the axial direction along the rotor, the outer surface defines a series of alternating peaks (where the ribs 22 are) and valleys between the peaks. The counter knife 14 has a series of teeth 24 that are axially aligned with the valleys between the ribs 22 of the rotor, there being one such tooth 24 for every valley in the rotor surface. Correspondingly, there are V-shaped recesses between the teeth 24 of the counter knife that are axially aligned with the ribs 22 of the rotor; thus, the rotor surface and the counter knife are complementary in configuration.

With reference to FIGS. 2 through 5, mounted to the outer surface of the rotor are a plurality of V-cutters 30 that are axially aligned with the ribs 22 and with the V-shaped recesses in the counter knife 14. There is at least one V-cutter 30 for every rib 22. Each V-cutter 30 has two radially outer faces that define two sharp cutting edges 32 (FIGS. 4 and 5) that come together in a general V shape with the vertex of the V pointing radially outwardly. The cutting edges 32 mesh with one of the V-shaped recesses between teeth 24 of the counter knife. Material that is fed into the space between the rotor and counter knife is cut by the V-cutters 30 as they mesh with the counter knife. The cutting edges 32 are approximately orthogonal to each other, although they advantageously have a slight curvature such that they are concave in the direction of rotation of the rotor, as shown, which promotes a scissoring effect between the V-cutters and the counter knife. The V-cutters 30 are circumferentially spaced apart about the rotor so that, preferably, all of the V-cutters are at different clockwise positions about the circumference and hence only one V-cutter at a time meshes with the counter knife. Each V-cutter 30 is mounted by a screw 34 to a tool holder 36 that is affixed to the rotor (such as by welding). The tool holders 36 are mounted within pockets 38 (FIG. 5) that are cut into the rotor surface. The V-cutters can be removed when damaged or dulled and can be replaced with new cutters.

Figure 4:
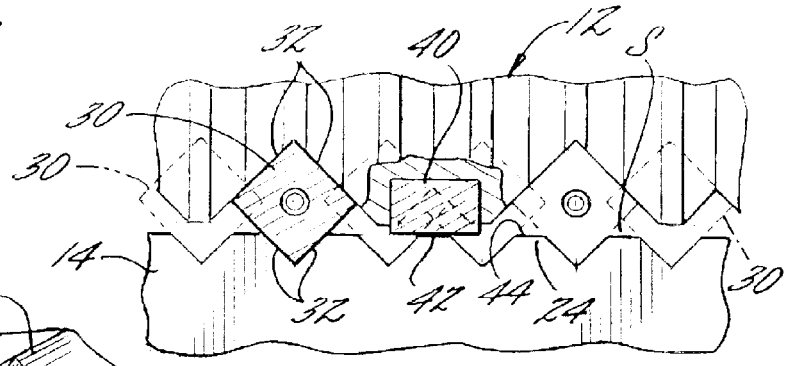
FIG. 4 is an enlarged fragmentary view of the rotor and counter knife.
Figure 5:
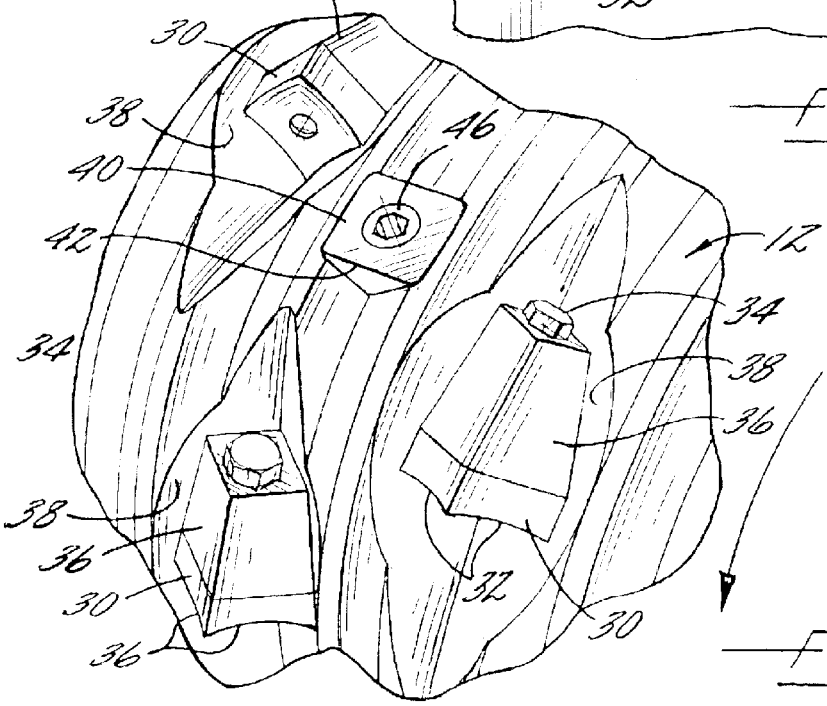
FIG. 5 is a perspective view of a portion of the rotor, showing several axially adjacent V-cutters and a flat cutter.

The V-cutters partially overlap one another in the axial direction, as depicted in FIG. 4. Even so, when the shredder is shredding fibrous material that tends to form long strings, the material can wrap around the rotor and lay in the valleys of the rotor surface. Material in the space S (FIG. 4) between axially adjacent V-cutters is inaccessible to the cutting edges of the V-cutters and therefore cannot be cut by the V-cutters. This material can accumulate and cause substantial friction between the rotor and counter knife as well as between the rotor and the screen, and can even jam the rotor.

To address this problem, the rotor in accordance with the invention includes a plurality of flat cutters 40 that are mounted in the valleys (at least one flat cutter per valley) between the ribs 22 of the rotor and thus are positioned between axially adjacent V-cutters 30. Each flat cutter 40 has a substantially flat or straight cutting edge 42 (FIGS. 2, 4, and 5) that is generally parallel to the axis of the rotor. The cutting edge 42 cooperates with a flat or straight end edge 44 (FIG. 4) of the corresponding tooth 24 of the counter knife to cut material located between axially adjacent V-cutters. Any stringy material that may tend to lay in the valleys of the rotor will be cut by the flat cutters. The flat cutters are mounted to the rotor by screws 46 so that they can be removed when they become damaged or dull and can be replaced with new cutters.

In a preferred embodiment of the invention, the V-cutters 30 have four cutting edges 32 that form four sides of a generally square configuration, each corner of which defines a cutting vertex. The V-cutters can be mounted to the rotor in any of four different rotational orientations each presenting a different one of the cutting vertices for meshing with the counter knife. If one cutting vertex becomes dull, the V-cutter can be repositioned to present a fresh cutting vertex.

Likewise, the flat cutters 40 have four cutting edges 42 that form four sides of a generally square configuration. The flat cutters can be mounted to the rotor in any of four different rotational orientations each presenting a different one of the cutting edges for meshing with the counter knife. If one cutting edge becomes dull, the flat cutter can be repositioned to present a fresh cutting edge. Alternatively, the flat cutters could have fewer than four cutting edges (e.g., two) and could be mountable to the rotor in different orientations each presenting a different one of the cutting edges for meshing with the counter knife.

At each rib 22 of the rotor, there can be just one V-cutter 30; alternatively, two or more V-cutters can be located at a rib and spaced circumferentially from each other. Likewise, at each valley of the rotor, there can be just one flat cutter 40 or two or more flat cutters. As an example, there can be twice as many V-cutters (two per rib) as there are flat cutters (one per valley).

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A shredder comprising:

at least one rotor rotatable about an axis and having an outer surface formed generally as a surface of revolution about the axis, the outer surface defining a succession of radially outwardly protruding circumferential ribs spaced apart axially along the rotor such that valleys are defined between the ribs;

a counter knife arranged in opposition to the outer surface of each rotor, a space being defined between the counter knife and the outer surface of the rotor for passage of material being shredded, the counter knife defining a succession of teeth spaced apart in the axial direction of the rotor such that recesses are defined between the teeth, each tooth being axially aligned with one of the valleys in the rotor's outer surface;

a plurality of V-cutters affixed to the outer surface of each rotor, each V-cutter having a pair of cutting edges forming a radially outwardly protruding V-shaped cutting vertex, the V-cutters being spaced apart axially such that each recess in the counter knife meshes with at least one V-cutter and such that each V-cutter partially overlaps in the axial direction with at least one other axially adjacent V-cutter; and a plurality of flat cutters affixed to the outer surface of each rotor, each flat cutter having a substantially straight cutting edge that is generally parallel to the axis of the rotor, each flat cutter being aligned in the axial direction with one of the valleys in the rotor's outer surface, whereby the flat cutters are positioned to work in conjunction with the counter knife to cut material disposed between two axially adjacent V-cutters.

2. The shredder of claim 1, wherein the V-cutters are circumferentially spaced apart about the rotor such that only one V-cutter at a time meshes with the counter knife.

3. The shredder of claim 1, wherein the teeth of the counter knife have flat end surfaces that oppose the flat cutters.

4. The shredder of claim 3, wherein the teeth of the counter knife do not overlap in a radial direction with the ribs of the rotor.

5. The shredder of claim 1, wherein the flat cutters are circumferentially spaced apart about the rotor such that only one flat cutter at a time meshes with the counter knife.

6. The shredder of claim 1, wherein the cutting edges of each V-cutter are at approximately a right angle to each other.

7. The shredder of claim 1, wherein each rib has opposite side faces that are oppositely inclined to the axis of the rotor.

8. The shredder of claim 7, wherein the side faces of each rib are conical.

9. The shredder of claim 7, wherein each rib has a top face that is generally parallel to the axis of the rotor.

10. The shredder of claim 1, wherein the V-cutters are mounted in pockets formed in the outer surface of the rotor.

11. The shredder of claim 10, wherein the V-cutters and flat cutters are mounted to the rotor with threaded fasteners.

12. The shredder of claim 11, wherein each V-cutter is a substantially square structure having four cutting edges that form four cutting vertices, and wherein the V-cutters are mountable to the rotor in any of four different positions each presenting a different one of the cutting vertices in position to mesh with the counter knife.

13. The shredder of claim 11, wherein each flat cutter is a multi-sided structure with more than one side of the structure defining a cutting edge, and the flat cutters are mountable to the rotor in any of a plurality of different positions each presenting a different one of the cutting edges in position to cooperate with the counter knife.

14. A component for a rotary shredder, comprising:

a rotor having an outer surface formed generally as a surface of revolution about an axis, the outer surface defining a succession of radially outwardly protruding circumferential ribs spaced apart axially along the rotor such that valleys are defined between the ribs;

a plurality of V-cutters affixed to the outer surface of the rotor, each V-cutter having a pair of cutting edges forming a radially outwardly protruding V-shaped cutting vertex, the V-cutter being spaced apart axially such that each recess in a counter knife meshes with at least one V-cutter and such that each V-cutter partially overlaps in the axial direction with at least one other axially adjacent V-cutter; and a plurality of flat cutters affixed to the outer surface of the rotor, each flat cutter having a substantially straight cutting edge that is generally parallel to the axis of the rotor, each flat cutter being aligned in the axial direction with one of the valleys in the rotor's outer surface, whereby the flat cutters are positioned to work in conjunction with a counter knife to cut material disposed between two axially adjacent V-cutters.

15. The component of claim 14, wherein the V-cutters are circumferentially spaced about the rotor such that all of the V-cutters are at different clockwise positions about the circumference.

16. The component of claim 14, wherein the V-cutters and flat cutters are mounted to the rotor with threaded fasteners so as to be removable and replaceable.

17. The component of claim 16, wherein the V-cutters are mountable to the rotor in any of a plurality of different orientations.

18. The component of claim 16, wherein the flat cutters are mountable to the rotor in any of a plurality of different orientations.

19. The component of claim 14, wherein the flat cutters are circumferentially spaced about the rotor such that all of the flat cutters are at different clockwise positions about the circumference.

* * * * *